US006188866B1

(12) United States Patent
Barnhart

(10) Patent No.: US 6,188,866 B1
(45) Date of Patent: Feb. 13, 2001

(54) DUPLEX IMAGE FORMING APPARATUS WITH REMOVABLE REFEEDER CASSETTE

(75) Inventor: James M. Barnhart, Williamsburg, VA (US)

(73) Assignee: Canon Virginia, Inc., Newport News, VA (US)

( * ) Notice: Under 35 U.S.C. 154(b), the term of this patent shall be extended for 0 days.

(21) Appl. No.: 09/370,905

(22) Filed: Aug. 10, 1999

(51) Int. Cl.[7] ..... G03G 15/00
(52) U.S. Cl. ..... 399/401; 399/402
(58) Field of Search ..... 399/18, 401, 402, 399/381, 391, 364; 271/3.03, 3.05, 3.08, 9.01

(56) References Cited

U.S. PATENT DOCUMENTS

| | | | | |
|---|---|---|---|---|
| 3,972,612 | | 8/1976 | Komori et al. | 355/26 |
| 4,538,906 | * | 9/1985 | Brown | 399/391 |
| 4,639,125 | | 1/1987 | Okuda et al. | 355/23 |
| 4,708,462 | | 11/1987 | Stemmle | 355/24 |
| 4,872,659 | * | 10/1989 | Kato et al. | 271/9.01 |
| 5,088,713 | | 2/1992 | Hayashi | 271/3.03 |
| 5,093,690 | | 3/1992 | Ohno et al. | 399/402 |
| 5,105,231 | | 4/1992 | Watanabe et al. | 399/403 |
| 5,327,206 | * | 7/1994 | Ueda et al. | 399/402 |
| 5,502,464 | | 3/1996 | Takahashi et al. | 346/25 |
| 5,791,645 | | 8/1998 | Takada | 271/3.03 |
| 5,857,138 | | 1/1999 | Iida et al. | 399/402 |
| 5,966,556 | * | 10/1999 | Nakagawa et al. | 399/18 |

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

An image forming apparatus selectively forms images on one or two sides of recording media. The apparatus includes an image forming engine, a port, a series of conveying rollers and guides, drivers and a microprocessor. The image forming engine forms images on the recording media. The port selectively receives a refeeder unit for receiving recording media having images formed on one side thereof by the image forming engine or a unit for storing unrecorded recording media. The series of conveying rollers and guides contact and convey the recording media, while the drivers drive the conveying rollers and guides. The microprocessor controls the image forming engine and the drivers of the conveying rollers and guides. The microprocessor enables the drivers of the conveying rollers and guides to convey recording media having images formed on one side thereof to the refeeder unit if the refeeder unit is mounted in the port and controls the drivers of the conveying rollers and guides to discharge recording media having images formed on one side thereof if the refeeder unit is not mounted in the port.

36 Claims, 4 Drawing Sheets

DUPLEX IMAGE FORMING APPARATUS WITH REMOVABLE REFEEDER CASSETTE

BACKGROUND OF THE INVENTION

1. Field of the Invention

This invention relates to a duplex (two-sided) image forming apparatus, which can selectively perform single-sided or double-sided image forming.

2. Description of Related Art

Duplex image forming is desirable in many situations in order to minimize the amount of recording media used. That is, as compared to single-sided image forming, the amount of used recording media can be cut in half because information is recorded on both sides thereof.

Several types of duplex copying apparatuses are known. In a typical duplex copying machine, conventional one-sided copying is first effected on the recording medium by a recording section, and then the recording medium is inverted and fed back through the recording section to effect the conventional one-sided copying on the reverse side.

However, duplex copiers of this type must be made sufficiently large to accommodate one or more paper supply cassettes as well as a refeeder section for holding the recording media, having been recorded on one side, to be refed to the image forming section.

Moreover, copying machines that are dedicated to single-sided copying are difficult to retrofit to enable double-sided recording.

SUMMARY OF THE INVENTION

It is, therefore, an object of the present invention to provide a duplex image forming apparatus than can occupy relatively small space.

It is a further object of the present invention to provide an inexpensive and compact duplex image forming apparatus.

It is still another object of the p resent invention to provide a duplex image forming apparatus that can reverse a recording medium in a simple manner.

It is yet another object of the present invention to provide a simple, inexpensive mechanism to retrofit a single-sided image forming apparatus into a double-sided image forming apparatus.

It is a further object of the present invention to provide a duplex image forming apparatus that can selectively effect either single-sided or double-sided image forming, as desired.

In one aspect of the present invention, an image forming apparatus selectively forms images on one or two sides of recording media and includes image forming means, receiving means, conveying means and controlling means. The image forming means forms images on the recording media. The receiving means receives a refeeder unit for receiving recording media having images formed on one side thereof by the image forming means. The conveying means conveys the recording media. The controlling means controls the image forming means and the conveying means. The controlling means enables the conveying means to convey recording media having images formed on one side thereof by the image forming means to the refeeder unit if the refeeder unit is mounted in the receiving means and the controlling means controls the conveying means to discharge recording media having images formed on one side thereof if the refeeder unit is not mounted in the receiving means.

In another aspect of the present invention, an image forming apparatus for selectively forming images on one or two sides of recording media includes an image forming engine, a port, a series of conveying rollers and guides, drivers and a microprocessor. The image forming engine forms images on the recording media. The port receives a refeeder unit for receiving recording media having images formed on one side thereof by the image forming engine. The series of conveying rollers and guides contact and convey the recording media, while the drivers drive the conveying rollers and guides. The microprocessor controls the image forming engine and the drivers of the conveying rollers and guides. The microprocessor enables the drivers of the conveying rollers and guides to convey recording media having images formed on one side thereof by the image forming engine to the refeeder unit if the refeeder unit is mounted in the port and the microprocessor controls the drivers of the conveying rollers and guides to discharge recording media having images formed on one side thereof if the refeeder unit is not mounted in the port.

In yet another aspect of the present invention, a refeeder unit is removably mountable in a single location of an image forming apparatus to enable two-sided image forming. The refeeder unit includes a tray, feeding means and an interface. The tray receives recording media having an image formed on one side thereof. The feeding means feeds the recorded recording media received on the tray. The interface is for connection with the image forming apparatus and indicates that the refeeder unit is mounted in the image forming apparatus.

In still another aspect of the present invention, a method for effecting image forming in an image forming apparatus operable in one-sided and two-sided image forming modes includes the step of effecting two-sided recording by mounting a refeeder unit at a predetermined location in the image forming apparatus, conveying a recording medium through an image forming area to have images formed on a first side thereof, conveying the recorded recording medium to the refeeder unit at the predetermined location, refeeding the recorded recording medium from the refeeder unit at the predetermined location through the image forming area to have images formed on a second side thereof, and discharging the recording medium having images formed on both sides thereof. The method further includes the step of effecting one-sided recording without the refeeder unit mounted in the image forming apparatus by conveying a recording medium through the image forming area to have images formed on a first side thereof and discharging the recorded recording medium.

In a further aspect of the present invention, an image forming apparatus selectively forms images on one or two sides of recording media and includes image forming means, receiving means, conveying means and controlling means. The image forming means forms images on the recording media. The receiving means selectively receives at a predetermined location one of a refeeder unit for receiving recording media having images formed on one side thereof by the image forming means and a media supply unit for storing unrecorded recording media for supply to the image forming means. The conveying means conveys the recording media. The controlling means controls the image forming means and the conveying means. In two-sided image forming, the controlling means controls the conveying means to convey recording media having images formed on one side thereof by said image forming means to the refeeder unit at the predetermined location.

In a still further aspect of the present invention, an image forming apparatus selectively forms images on one or two sides of recording media and includes an image forming engine, a port, a series of conveying rollers and guides, drivers and a microprocessor. The image forming engine forms images on the recording media. The port selectively receives one of a refeeder unit for receiving recording media having images formed on one side thereof by the image forming engine and a media supply unit for storing unrecorded recording media for supply to the image forming engine. A series of conveying rollers and guides contact and convey the recording media, while the drivers drive the conveying rollers and guides. The microprocessor controls the image forming engine and the drivers of the conveying rollers and guides. In two-sided image forming, the microprocessor controls the drivers of the conveying rollers and guides to convey recording media having images formed on one side thereof by the image forming engine to the refeeder unit received in the port.

These and other objects, aspects, features and advantages of the present invention will become apparent from the following detailed description of the preferred embodiments taken in conjunction with the accompanying drawings.

DETAILED DESCRIPTION OF THE PREFERRED EMBODIMENTS

An embodiment of the image forming apparatus to which the present invention is applied will now be described.

Figure 1:
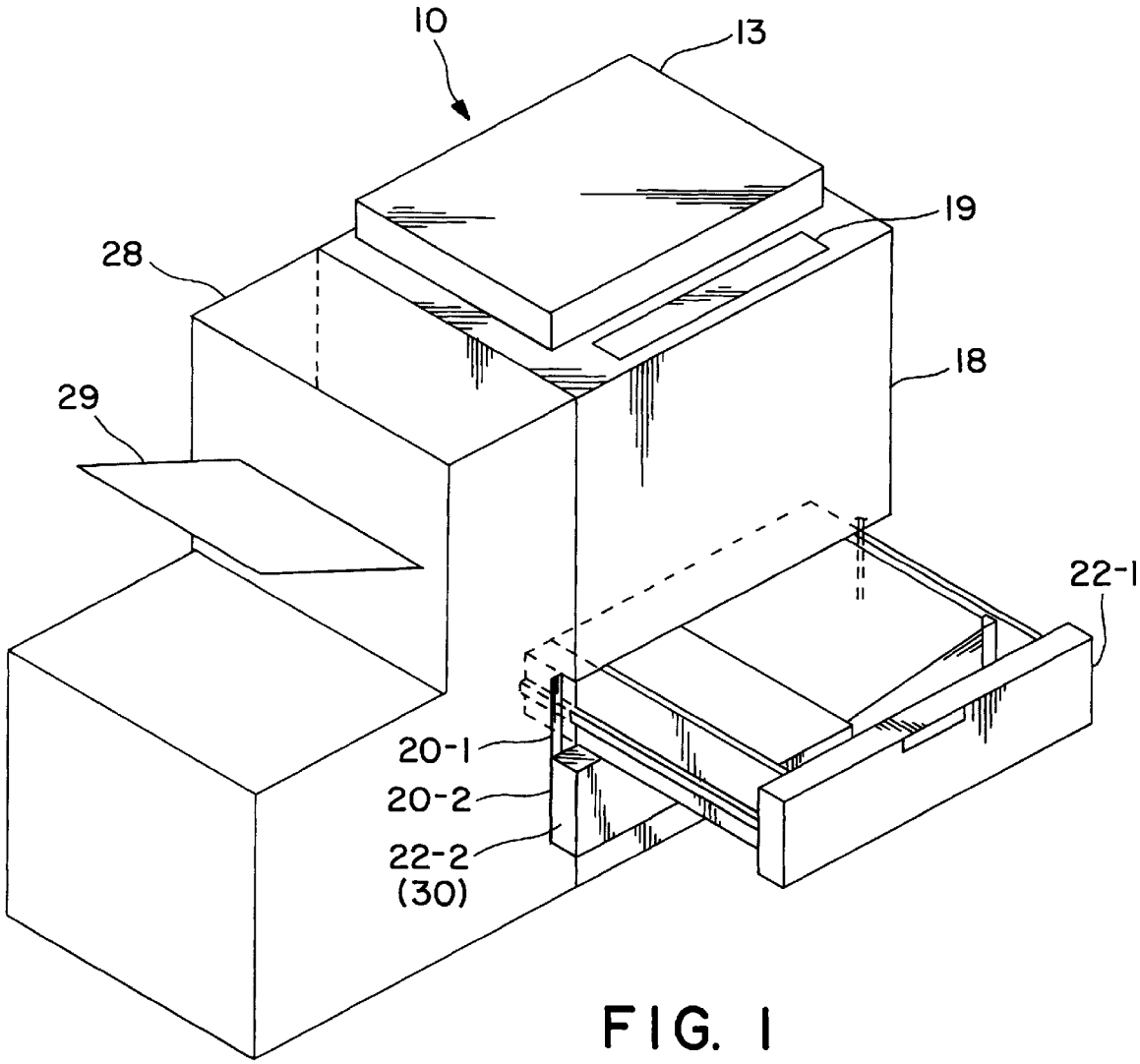
FIG. 1 is a perspective view of an embodiment of the image forming apparatus according to the present invention.
Figure 2:
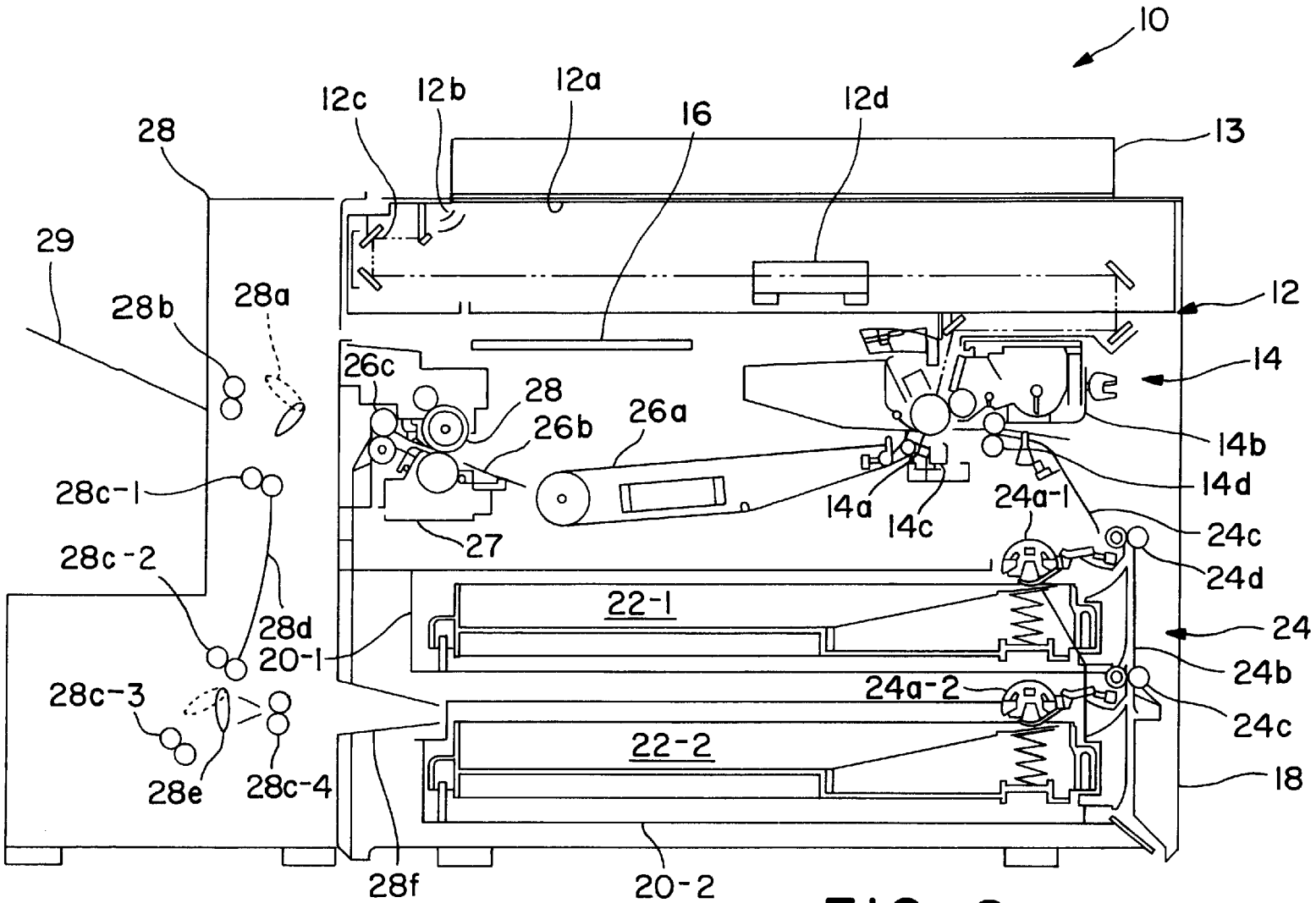
FIG. 2 is a front cross-sectional view of the image forming apparatus shown in FIG. 1.

As shown in FIGS. 1 and 2, the image forming apparatus of the present invention is generally designated by reference numeral 10. In a preferred embodiment, image forming apparatus 10 is in the form of a copying machine having an original reading section 12, an image forming section 14 and a control section 16 disposed in a housing 18.

Original reading section 12 is of a well-known type and can selectively read images from single-sided or double-sided originals positioned at a reading area. The reading area is defined by a glass plate 12*a,* for example, upon which original documents are positioned. An original document positioned on glass plate 12*a* is scanned by scanning lamp 12*b* and the illuminated image is guided by a series of reflecting mirrors 12*c* and a lens 12*d* to the image forming section. Original reading section 12 can include an automatic sheet or document feeder 13, of well-known construction, that automatically feeds one or more original document sheets to and from the reading area. Automatic sheet feeder 13 can also invert an original document so that both sides thereof can be read.

Image forming section 14 can also be of any well-known type. For example, the printing engine of image forming section 14 can be of the electrophotographic type, as exemplified in FIG. 2. The electrostatic image forming engine includes a photosensitive drum 14*a*upon which the scanned, illuminated image is directed by reading section 12 to form a latent image. A sheet of recording medium is introduced to image forming section 14 by registration rollers 14*d,* while toner from toner supply 14*b* is deposited on the photosensitive drum and transferred to the introduced recording medium by a transfer corona unit 14*c* to form a recorded image thereon. Other types of image forming sections, such as an ink-jet type, can be used and still achieve the desired effects of the present invention.

Control section 16 includes a microprocessor unit as well as appropriate memories and will be described in more detail later.

Housing 18 is provided with two or more ports, 20-1, 20-2 for receiving two or more recording media units or cassettes 22-1, 22-2. Cassettes 22-1, 22-2 store the recording media in stacks to be supplied to image forming section 14. Typically, cassettes 22-1, 22-2 store different types of recording media, such as recording media of different sizes.

Recording media are fed from supply cassettes 22-1, 22-2 to image forming section 14 through supply section 24. Supply section 24 defines a conveyance path to recording section 14 by way of pick-up rollers 24*a,*guides 24*b,* 24*c* and roller pairs 24*d,* 24*e*. To supply a sheet of recording medium from lower cassette 22-2, for example, pick-up roller 24*a* rotates against the top sheet in the stack to convey the top sheet to roller pair 24*e*. The sheet is then conveyed through guide 24*b* to roller pair 24*d* and then to guide 24*c*. The sheet is conveyed to registration roller pair 14*d* to be conveyed through the image forming section. The various rollers are driven by any suitable driving device.

After the fed recording medium is recorded in image forming section 14, it is exhausted by exhausting section 26. The exhausting section defines a conveyance path comprised of a belt 26*a,* guide 26*b* and delivery roller pair 26*c*. Preferably, a fixing unit 27 is disposed in the exhausting path to fix the formed image before delivery.

Figure 3:
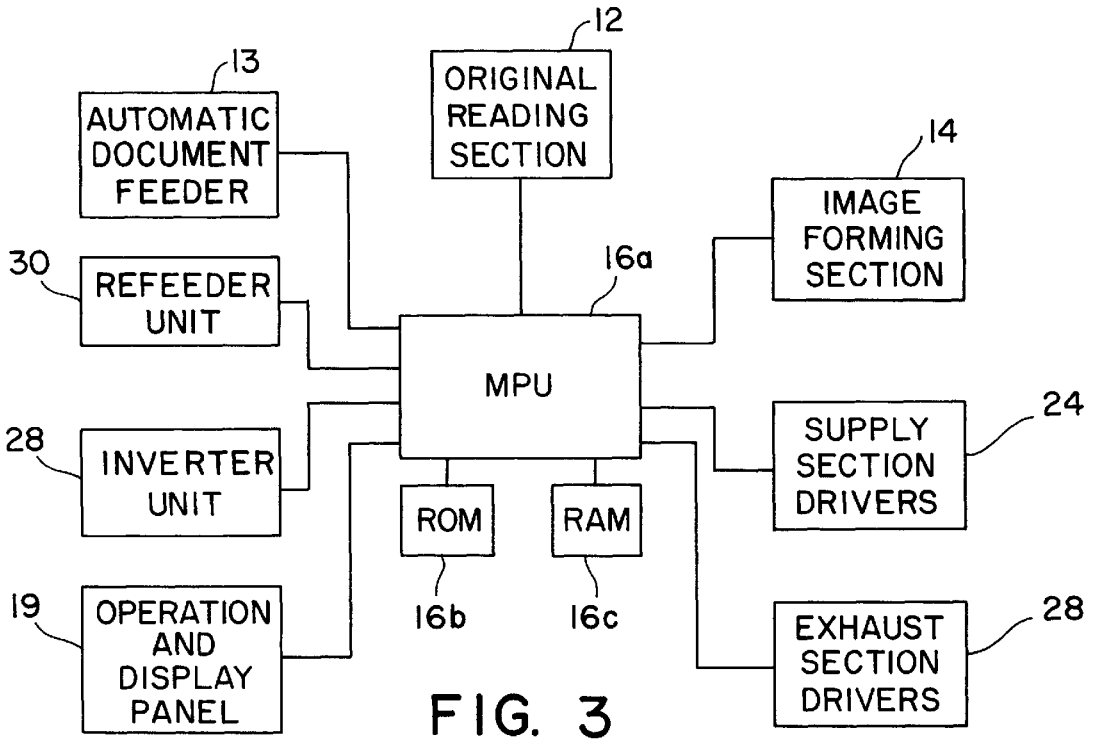
FIG. 3 is a schematic view of the image forming apparatus of the present invention.

The control of the image forming apparatus is shown schematically in FIG. 3. Control section 16 includes microprocessor unit 16*a* as well as a ROM 16*b* for storing control programs and a RAM 16*c* functioning as a work area. MPU 16*a* can control the reading functions of original reader 12, the feeding functions of automatic document feeder 13, the image forming functions of image forming section 14 and the conveying functions of supply section 24 and exhausting section 26. An operation and display panel 19, disposed on the outer surface of housing 18, communicates with MPU 16*a*. Panel 19 can display available options to a user, as is well-known, and the user can make various selections, such as number of copies, magnification, and the like, through the panel.

In forming a single-sided image, an original is fed to or placed on the reading area 12*a,* the original image of one side is read by reading section 12, and image data is transferred to image forming section 14. A sheet of recording paper is then fed from one of cassettes 22-1, 22-2 through supply section 24 to image forming section 14. An image is formed on the fed recording medium and then exhausted by exhausting section 26.

Image forming apparatus 10 is also capable of performing double-sided image forming. In order to effect double-sided recording, image forming apparatus 10 is provided with an inverter section 28 and a refeeder unit 30. Inverter section 28 can be mounted to image forming apparatus 10 regardless of whether single-sided or double-sided image forming is to be effected. Refeeder unit 30 is preferably mounted in lower port 20-2 in place of cassette 22-2, but is not limited to this position.

Inverter section 28 includes a flapper 28*a,* a pair of exhausting rollers 28*b* and a series of inverting rollers 28*c* and guides 28*d.* Flapper 28*a* is selectively controlled to either guide the recording medium to exhausting rollers 28*b* to be discharged onto discharge tray 29 or to a series of inverting rollers 28*c,* and guides 28*d* when another side of the recording medium is to be recorded.

When flapper 28*a* is switched to the downward position as shown in solid in FIG. 2, a recorded recording medium is directed to reversing rollers 28*c* and conveyed until the trailing end of the medium passes gate 28*e.* At this point, the rotation direction of inverting rollers 28*c*-3 is reversed such that the trailing end of the medium becomes the leading end. The medium is then guided by roller pair 28*c*-4 through guide 28*f* into refeeder unit 30 mounted in lower port 20-2. The medium is thus supplied to refeeder unit 30 in an inverted orientation. That is, the medium, which had been stored in cassette 22-1 with one side facing upward, is fed into refeeder unit 30 with its opposite side facing upward. The inverted recorded recording medium can be refed by supply section 24 to image forming section 14 to have an image formed on its second side.

The various rollers and flapper 28*b* are controlled throughout conveyance of the media by MPU 16*a.* The timing of the control can be based on signals from unshown medium detectors positioned throughout the conveyance paths.

Figure 4:
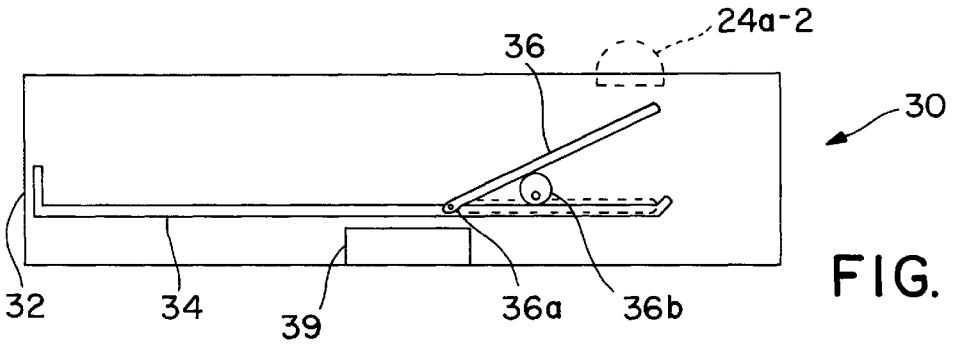
FIG. 4 is a cross-sectional view of a first embodiment of a refeeder unit according to the present invention.
Figure 5:
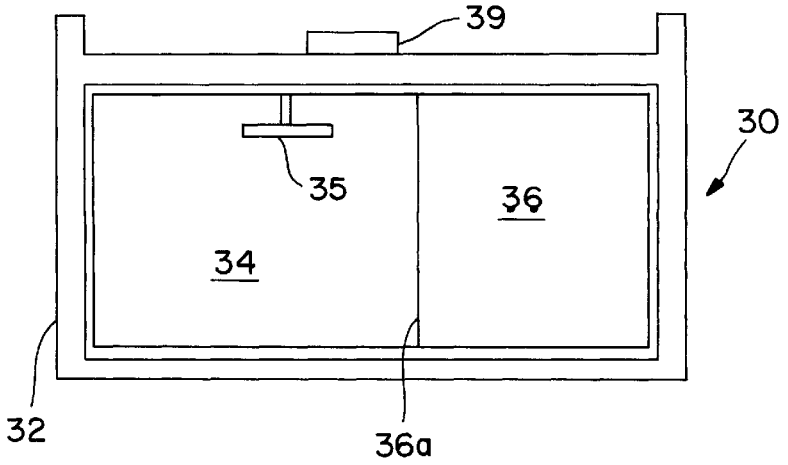
FIG. 5 is a plan view of the refeeder unit depicted in FIG. 4.

The details of the first embodiment of refeeder unit 30 will now be described. As shown in FIGS. 4 and 5, refeeder unit 30 includes casing 32 supporting a recording medium tray 34. Refeeder unit 30 can be in the form of a cassette of substantially the same size and shape as recording medium supply cassette 22-2.

Recording media from inverter section 28 enter the refeeder unit 30 from the left side shown in the Figure, are stacked, and are discharged from the right side to be refed to the image forming unit. A side jogger 35 aligns the stack of paper on tray 34. At the right side of tray 34, a lifting plate 36 is provided. Lifting plate 36 is pivoted at 36*a* between a first, lowered position (shown in phantom) flat against tray 34 and a second, raised position (shown in solid). A lift cam 36*b,* which abuts against the bottom side of lift plate 36, is rotatably controlled by an unshown driver to move the lift plate between the first and second positions. When refeeder unit 30 is mounted in lower port 20-2, D-shaped pick-up roller 24*a*-2 of supply section 24 is disposed at the right side of the unit above lift plate 36. In order to refeed paper stacked on tray 34, cam 36*b* is rotated to raise lift plate 36 to the feed position. Pick-up roller 24*a* is controlled to rotate against the top sheet of paper to feed the topmost sheet from refeed unit 30 into supply section 24.

Refeeder unit 30 is provided on the outer surface of casing 34 with an interface 39 to connect with a corresponding interface (not shown) in port 20-2 of image forming apparatus 10. Through interface 39, control unit 16 can control the operation of refeeder unit 30. Namely, control section 16 can send signals and power to energize the driver for lift cam 36*b.*

Interface 39 also signals to MPU 16*a* of the image forming apparatus that the refeeder unit is mounted and that two-sided image forming can be effected. When refeeder unit 30 is mounted, MPU 16*a* can control display panel 19 to indicate that two-sided image forming is an option for a user.

When two-sided image forming is selected and refeeder unit 30 is mounted in port 20-2, in place of recording medium supply cassette 22-2, one side of an original document is read by reading section 12. A recording medium is fed from upper cassette 22-1 by supply section 24 to image forming section 14. An image is formed on one surface of the medium and then discharged by discharge section 26 to inverter section 28. Because two-sided recording is to be effected, flapper 28*a* is positioned to guide the medium to the inverting rollers 28*c* and guides 28*d.*

The partially-recorded recording medium is then inverted and guided into the inlet side of refeeder unit 30, which has its lift plate 36 in the lower position. If more than one copy of the original document is to be made, the desired number of recording media are fed, recorded, inverted and stacked upon the first-fed sheet in refeeder unit 30. When image data for the second side of the recording media has been input into image forming unit 14, each recording medium with an image formed on one side thereof, beginning with the topmost sheet, is refed from refeeder unit 30 through supply section 24 to image forming section 14 to have an image formed on its unrecorded side. After the recording medium has images formed on both sides thereof, it is conveyed from recording unit 14 through exhausting section 26 and to inverting unit 28. At this point, flapper 28*a* is controlled to guide the recording medium to exhausting rollers 28*b* and onto discharge tray 29.

Image forming apparatus 10 can form single or multiple copies of one or more original documents. If plural copies of a single original is desired, one side of the original document is repeatedly read and the read image is repeatedly formed on recording media successively fed from cassette 22-1. The partially-recorded media are then fed to inverter section 28, inverted and stacked on refeeder unit 30. The original document is the flipped over, either manually or by automatic document feeder 13, and the reverse side is repeatedly read. The read image is then repeatedly formed on the reverse sides of the recording media successively refed from refeeder unit 30. The completely recorded media are discharged onto discharge tray 29.

When one copy each of two or more original documents is desired, the one side of each original is read and formed on successively fed recording media, which are inverted and stacked on refeeder unit 30. The order of the original documents is reversed as they are flipped over, either manually or by automatic document feeder 13, and their opposite sides read. The read images are then formed on the reverse sides of the recording media successively refed from refeeder unit 30 and the media are discharged. If plural copies of each original is desired, the process is similar, but each side of each original is read repetitively and the read images are formed repetitively on successive recording media.

Figure 6:
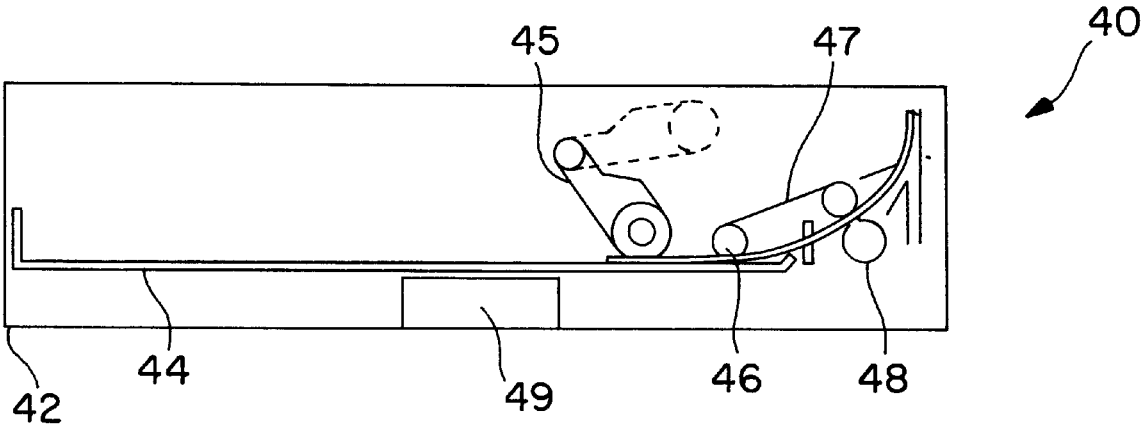
FIG. 6 is a cross-sectional view of a second embodiment of the refeeder unit according to the present invention.

Another embodiment of the refeeder unit is shown in FIG. 6. Refeeder unit 40 includes a casing 42, a tray 44 and an interface 49 similar to that in refeeder unit 30. An urger roller 45 is also provided and is pivotable between an upper position (shown in phantom) and a lower position (shown in solid) in the Figure. Refeeder unit 40 further includes feed rollers 46 connected by belt 47, which feeds media out of the unit, and retard roller 48, which rotates reversely to feed rollers 46 to ensure one sheet is fed at a time. Partially-recorded recording media are fed into refeeder unit 40 from inverter section 28 and stacked with urger roller 45 disposed in the upper position. When sheets are to be refed from refeeder unit 40, urger roller 45 rotates to feed a sheet to feed rollers 46. Feed rollers 46 and retard roller 48 are rotated to refeed one sheet at a time. The refed sheets can be conveyed directly to supply rollers 24*e*.

Figure 7:
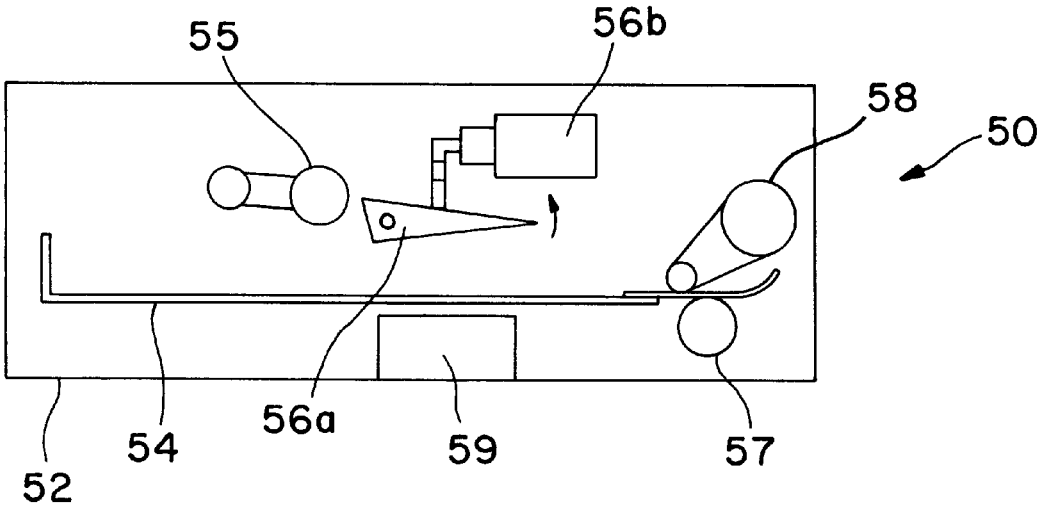
FIG. 7 is a cross-sectional view of a third embodiment of the refeeder unit according the present invention.

A third embodiment of the refeeder unit is shown in FIG. 7. Refeeder unit 50 also includes a casing 52, a tray 54 and an interface 59. In addition, the unit includes a pivotable urger roller 55, a stopper plate 56*a* controlled by a solenoid 56*b*, a separation roller 57 and a feed roller pair and belt 58. When inverted sheets are fed from inverter unit 28 to refeeder unit 50, urger roller 55 is held in the raised position, while stopper plate 56*a* is pivoted into its lowered position. The inverted sheets are then stacked with their leading ends abutting against the stopper plate. When sheets are to be refed from refeeder cassette 50, urger roller 55 is lowered upon the stack of sheets while stopper plate 56*a* is raised by solenoid 56*b*.Sheets are then sent by urger roller 55 to feed rollers 58 and separation roller 57 so that one sheet is refed at a time.

In each of the foregoing embodiments, motive devices such as solenoids and roller drivers are provided within the refeeder cassettes and require power to be provided thereto. However, motive sources can be provided in the body of the image forming apparatus to transmit motive force to the various components of the refeeder cassettes. For example, drive gears in the image forming apparatus can engage with slave gears of the refeeder cassettes to drive the various rollers and other components, as required.

While the present invention has been described as to what is currently considered to be the preferred embodiments, it is to be understood that the invention is not limited to them. To the contrary, the invention is intended to cover various modifications and equivalent arrangements within the spirit and scope of the appended claims. The scope of the following claims is to be accorded the broadest interpretation so as to encompass all such modifications and equivalent structures and functions.

What is claimed is:

1. An image forming apparatus for selectively forming images on one or two sides of recording media, said apparatus comprising:

an image forming engine, said image forming engine forming images on the recording media;

a port for receiving a refeeder unit for receiving recording media having images formed on one side thereof by said image forming engine;

a series of conveying rollers and guides contacting and conveying the recording media;

drivers driving said conveying rollers and guides; and a microprocessor controlling said image forming engine and said drivers of said conveying rollers and guides, wherein said microprocessor enables said drivers of said conveying rollers and guides to convey recording media having images formed on one side thereof by said image forming engine to the refeeder unit if the refeeder unit is mounted in said port and said microprocessor controls said drivers of said conveying rollers and guides to discharge recording media having images formed on one side thereof if the refeeder unit is not mounted in said port.

2. An apparatus according to claim 1, wherein said conveying rollers and guides convey recording media received by the refeeder unit to said image forming engine to have images formed on second sides thereof.

3. An apparatus according to claim 1, wherein said port selectively receives one of the refeeder unit and a unit for storing unrecorded recording media to be supplied to said image forming engine.

4. An apparatus according to claim 1, further comprising a second port for receiving a unit for storing unrecorded recording media to be supplied to said image forming engine.

5. An apparatus according to claim 1, wherein said port comprises a detector that detects whether the refeeder unit is mounted in said port, said detector signaling said microprocessor if the refeeder unit is mounted in said port.

6. An apparatus according to claim 1, wherein said port comprises an interface for connecting with the refeeder unit, said microprocessor controlling the refeeder unit through said interface.

7. An apparatus according to claim 1, further comprising an inverting section formed of additional conveying rollers and guides for inverting the recording media having images formed on one side thereof before being supplied to the refeeder unit.

8. An image forming apparatus for selectively forming images on one or two sides of recording media, said apparatus comprising:

image forming means for forming images on the recording media;

receiving means for receiving a refeeder unit for receiving recording media having images formed on one side thereof by said image forming means;

conveying means for conveying the recording media; and controlling means for controlling said image forming means and said conveying means, wherein said controlling means enables said conveying means to convey recording media having images formed on one side thereof by said image forming means to the refeeder unit if the refeeder unit is mounted in said receiving means and said controlling means controls said conveying means to discharge recording media having images formed on one side thereof if the refeeder unit is not mounted in said receiving means.

9. An apparatus according to claim 8, wherein said conveying means conveys recording media received by the refeeder unit to said image forming means to have images formed on second sides thereof.

10. An apparatus according to claim 8, wherein said receiving means selectively receives one of the refeeder unit and a unit for storing unrecorded recording media to be supplied to said image forming means.

11. An apparatus according to claim 8, further comprising second receiving means for receiving a unit for storing unrecorded recording media to be supplied to said image forming means.

12. An apparatus according to claim 8, wherein said receiving means comprises detecting means for detecting whether the refeeder unit is mounted in said receiving means, said detecting means signaling said controlling means if the refeeder unit is mounted in said receiving means.

13. An apparatus according to claim 8, wherein said receiving means comprises an interface for connecting with the refeeder unit, said control means controlling the refeeder unit through said interface.

14. An apparatus according to claim 8, wherein said conveying means comprises inverting means for inverting the recording media having images formed on one side thereof before being supplied to the refeeder unit.

15. A refeeder unit being removably mountable in a single location of an image forming apparatus to enable two-sided image forming, a media supply unit being alternately removably mountable in the single location of the image forming apparatus, said refeeder unit comprising:

a tray for receiving recording media having an image formed on one side thereof;

feeding means for feeding the recorded recording media received on said tray; and an interface for connection with the image forming apparatus, said interface for indicating that said refeeder unit is mounted in the image forming apparatus.

16. A refeeder unit according to claim 15, wherein said interface receives signals for controlling said feeding means.

17. A refeeder unit according to claim 15, wherein said feeding means comprises a feeding roller.

18. A refeeder unit according to claim 15, wherein power is supplied to said feeding means through said interface.

19. A refeeder unit according to claim 15, wherein said refeeder unit is in the form of a cassette.

20. A method for effecting image forming in an image forming apparatus operable in one-sided and two-sided image forming modes, said method comprising the steps of:

effecting two-sided recording by mounting a refeeder unit at a predetermined location in the image forming apparatus, conveying a recording medium through an image forming area to have images formed on a first side thereof, conveying the recorded recording medium to the refeeder unit at the predetermined location, refeeding the recorded recording medium from the refeeder unit at the predetermined location through the image forming area to have images formed on a second side thereof, and discharging the recording medium having images formed on both sides thereof; and effecting one-sided recording without the refeeder unit mounted in the image forming apparatus by conveying a recording medium through the image forming area to have images formed on a first side thereof and discharging the recorded recording medium.

21. A method according to claim 20, wherein in effecting two-sided recording, the recording medium having images formed on only one side thereof is inverted before being conveyed to the refeeder unit.

22. A method according to claim 20, wherein in effecting one-sided recording, the refeeder unit is replaced in the image forming apparatus with a supply unit storing unrecorded recording media.

23. An image forming apparatus for selectively forming images on one or two sides of recording media, said apparatus comprising:

image forming means for forming images on the recording media;

receiving means for selectively receiving at a predetermined location one of a refeeder unit for receiving recording media having images formed on one side thereof by said image forming means and a media supply unit for storing unrecorded recording media for supply to said image forming means;

conveying means for conveying the recording media; and controlling means for controlling said image forming means and said conveying means, wherein in two-sided image forming, said controlling means controls said conveying means to convey recording media having images formed on one side thereof by said image forming means to the refeeder unit at the predetermined location.

24. An apparatus according to claim 23, wherein said conveying means conveys recording media received by the refeeder unit to said image forming means to have images formed on second sides thereof.

25. An apparatus according to claim 23, further comprising second receiving means for receiving another media supply unit for storing unrecorded recording media to be supplied to said image forming means.

26. An apparatus according to claim 23, wherein said receiving means comprises detecting means for detecting whether the refeeder unit is mounted in said receiving means, said detecting means signaling said controlling means if the refeeder unit is mounted in said receiving means.

27. An apparatus according to claim 23, wherein said receiving means comprises an interface for connecting with the refeeder unit, said control means controlling the refeeder unit through said interface.

28. An apparatus according to claim 23, wherein said conveying means comprises inverting means for inverting the recording media having images formed on one side thereof before being supplied to the refeeder unit.

29. An apparatus according to claim 23, wherein said controlling means effects two-sided image forming only if said refeeder unit is received in said receiving means.

30. An image forming apparatus for selectively forming images on one or two sides of recording media, said apparatus comprising:

an image forming engine, said image forming engine forming images on the recording media;

a port for selectively receiving one of a refeeder unit for receiving recording media having images formed on one side thereof by said image forming engine and a media supply unit for storing unrecorded recording media for supply to said image forming engine;

a series of conveying rollers and guides contacting and conveying the recording media;

drivers driving said conveying rollers and guides; and a microprocessor controlling said image forming engine and said drivers of said conveying rollers and guides, wherein in two-sided image forming, said microprocessor controls said drivers of said conveying rollers and guides to convey recording media having images formed on one side thereof by said image forming engine to the refeeder unit received in said port.

31. An apparatus according to claim 30, wherein said conveying rollers and guides convey recording media received by the refeeder unit to said image forming engine to have images formed on second sides thereof.

32. An apparatus according to claim 30, is further comprising a second port for receiving another media supply unit for storing unrecorded recording media to be supplied to said image forming engine.

33. An apparatus according to claim 30, wherein said port comprises a detector that detects whether the refeeder unit is mounted in said port, said detector signaling said microprocessor if the refeeder unit is mounted in said port.

34. An apparatus according to claim 30, wherein said port comprises an interface for connecting with the refeeder unit, said microprocessor controlling the refeeder unit through said interface.

35. An apparatus according to claim 30, further comprising an inverting section formed of additional conveying rollers and guides for inverting the recording media having images formed on one side thereof before being supplied to the refeeder unit.

36. An apparatus according to claim 30, wherein said microprocessor effects two-sided image forming only if said refeeder unit is received in said port.

* * * * *

UNITED STATES PATENT AND TRADEMARK OFFICE

CERTIFICATE OF CORRECTION

PATENT NO. : 6,188,866 B1
DATED : February 13, 2001
INVENTOR(S) : Barnhart

It is certified that error appears in the above-identified patent and that said Letters Patent is hereby corrected as shown below:

Column 1,
Line 38, "p resent" should read -- present --.

Column 4,
Line 3, "drum 14*a*upon" should read -- drum 14*a* upon --.

Column 10,
Line 46, "is" should be deleted.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*